US008333503B2

(12) United States Patent
Hiranuma et al.

(10) Patent No.: US 8,333,503 B2
(45) Date of Patent: Dec. 18, 2012

(54) PORTABLE TIMEPIECE

(75) Inventors: Haruki Hiranuma, Chiba (JP); Kazutaka Imai, Chiba (JP)

(73) Assignee: Seiko Instruments Inc. (JP)

( * ) Notice: Subject to any disclaimer, the term of this patent is extended or adjusted under 35 U.S.C. 154(b) by 276 days.

(21) Appl. No.: 12/806,993

(22) Filed: Aug. 25, 2010

(65) Prior Publication Data

US 2011/0051571 A1 Mar. 3, 2011

(30) Foreign Application Priority Data

Aug. 28, 2009 (JP) ..... 2009-198714

(51) Int. Cl.
*G04B 37/00* (2006.01)

(52) U.S. Cl. ..... 368/286; 368/291

(58) Field of Classification Search ..... 368/286–292
See application file for complete search history.

(56) References Cited

U.S. PATENT DOCUMENTS 2,391,803 A * 12/1945 Simon ..... 368/290
3,188,793 A * 6/1965 Morf ..... 368/290
3,525,211 A * 8/1970 Wyssen ..... 368/289
4,783,772 A * 11/1988 Umemoto et al. ..... 368/11
5,257,247 A * 10/1993 Miche et al. ..... 368/290
5,521,890 A * 5/1996 Miche et al. ..... 368/319

OTHER PUBLICATIONS

Patent Abstracts of Japan, publication No. 2003-240877, publication date Aug. 27, 2003.

* cited by examiner

*Primary Examiner* — Sean Kayes
(74) *Attorney, Agent, or Firm* — Adams & Wilks

(57) ABSTRACT

A portable timepiece has a timepiece exterior assembly with a mounting hole having seal surfaces and escape portions. A valve member has a shaft portion movably inserted into the mounting hole and a head portion connected to the shaft portion. An urging member is provided between the head portion and the assembly for urging the valve member toward the interior of the assembly. Seal members are mounted to the shaft portion in correspondence with the seal surfaces. The seal members are configured to be moved between a sealing position in which the seal members are held in contact with the seal surfaces, and an exhaust position in which the seal members are opposed to the respective escape portions. In the sealing position, the seal members define a closed space together with an outer periphery of the shaft portion and the escape portions opposed to the outer periphery.

8 Claims, 4 Drawing Sheets

PORTABLE TIMEPIECE

BACKGROUND OF THE INVENTION

1. Field of the Invention

The present invention relates to a portable timepiece in which there is a possibility of the inner pressure of the timepiece exterior assembly being enhanced, for example, as in the case of a diver's watch for saturation diving and the like.

2. Background Information

There is known a diver's watch for saturation diving in which, to cope with a case in which the inner pressure of the case has become higher than the outer pressure, an automatic degassing valve provided in the case is operated, making it possible to automatically discharge the gas inside the case to the exterior of the case (See, for example, JP-A-2003-240877 Patent Document 1).

The automatic degassing valve with which the diver's watch is equipped has a stepped hole extending through the case, a pipe, a valve, a coil spring, and waterproof packing.

More specifically, a small diameter hole portion of the stepped hole is open to the inner side of the case, and a large diameter hole portion of the stepped hole is open to the outer side of the case. The pipe has a step portion, and is inserted into the small diameter hole portion from the large diameter hole portion, with positioning being effected thereon at the step formed by the small diameter hole portion and the large diameter hole portion. At least a part of the valve is inserted into the interior of the pipe so as to be axially movable, and this valve has a head portion situated on the large diameter hole portion side, and a receiving portion situated in the small diameter hole portion. The coil spring is held in a compressed state between the step portion and the receiving portion, urging the valve toward the inner side of the case. The waterproof packing is provided so as to be compressed between the pipe portion overlapping the step of the stepped hole and the head portion of the valve by the urging force of the coil spring.

When the inner pressure of the case is lower than the urging force of the coil spring, this automatic degassing valve is maintained in the closed state. However, the inner pressure of the case is enhanced by the helium gas entering the case with the saturation diving operation, so that, under the atmospheric pressure, the valve is moved toward the outer side of the case against the urging force of the coil spring, whereby the compression of the waterproof packing is released. In this way, the automatic degassing valve is opened, so that the gas in the case is discharged. As a result, there is no difference in pressure between the interior and exterior of the case; then, the automatic degassing valve is placed in the closed state again by the urging force of the coil spring.

In a residential area of a helium gas atmosphere installed under water, the helium gas in this residential area is transmitted through the waterproof packing of the automatic degassing valve with which the diver's valve of Patent Document 1 is equipped, and enters the case of the diver's watch. In this case, in addition to the fact that only one waterproof packing is used, the waterproof performance due to this waterproof packing mainly depends on the coil spring; however, the urging force of the coil spring compressing the waterproof packing involves relatively large variation from spring to spring. Thus, in the diver's watch of Patent Document 1, it is highly possible that the helium gas used in saturation diving being transmitted through the waterproof enters the case, and the inner pressure of this case is likely to be enhanced.

Further, in a situation in which the automatic degassing valve is opened after saturation diving, there is a possibility of water being accumulated in the large diameter hole portion of the stepped hole, and, under rainy weather, rain water may enter the large diameter hole portion. When degassing is automatically performed in such a situation, there may be a fear of the water in the large diameter hole portion entering the case immediately after the completion of exhaust and in a state in which the waterproof packing is not compressed.

As described above, in the prior art technique, gas is likely to be transmitted from the outside into the case via the automatic degassing valve, and there is a fear of water being allowed to enter from the outside with the completion of the degassing operation.

SUMMARY OF THE INVENTION

To solve the above problems, according to the present invention, there are provided: a timepiece exterior assembly equipped with a valve member mounting hole having a plurality of seal surfaces and a plurality of escape portions, with communication being established between the interior and exterior via this mounting hole; a valve member equipped with a valve member shaft portion having a detachment preventing portion to be caught by an edge portion of the valve member mounting hole from the outside of the timepiece exterior assembly and movably inserted into the valve member mounting hole, and a valve member head portion arranged inside the timepiece exterior assembly while connected to the valve member shaft portion; an urging member provided between the valve member head portion and the timepiece exterior assembly and urging the valve member toward the inner side of the timepiece exterior assembly; and a plurality of seal members mounted to the valve member shaft portion in correspondence with the plurality of seal surfaces, moved between a sealing position where they are held in contact with the seal surfaces while exhibiting interference and an exhaust position opposed to the escape portions through axial reciprocating movement of the valve member, and defining a closed space together with the outer periphery of the valve member shaft portion and the escape portions opposed to this outer periphery while in contact with the seal surfaces.

In the present invention, the diameters of the hole portions formed by the plurality of seal surfaces may be the same with or different from each other, and the diameters of the hole portions formed by the plurality of escape surfaces may be the same with or different from each other. In the present invention, it is desirable for the valve member mounting hole to be formed by a pipe attached to the timepiece exterior assembly; however, instead, it is also possible to directly form a hole in the case band or the like of the timepiece exterior assembly, using that hole as the valve member mounting hole. In the present invention, it is desirable for the detachment preventing portion of the valve member to be formed integrally with the valve member shaft portion; however, it may also be formed as a member separate from the valve member shaft portion and mounted to the valve member shaft portion. In the present invention, a coil spring may be suitably used as the urging member; however, it may also be a plate spring or the like; and the urging force of this urging member is set to be somewhat higher than the designated air pressure, e.g., the atmospheric pressure. In the present invention, the expression: the seal member "exhibits interference" implies a state in which the seal member is held in intimate contact with the seal surface while reduced in diameter as compared with the free state.

In the normal state of the portable timepiece of the present invention, the valve member is maintained in a state in which the detachment preventing portion of the valve member is caught by an edge portion of the valve member mounting hole due to the urging by the urging member, and a plurality of seal members are arranged at sealing positions, each exhibiting interference. In this state, a plurality of sealing portions due to the seal members are formed in the axial direction of the valve member, forming a closed space between the seal members adjacent to each other in the axial direction. Thus, in a situation in which a seal member penetrating gas such as helium gas used in saturation diving is transmitted through the seal members, the pressure gradient from the exterior to the interior of the timepiece exterior assembly is reduced stepwise, so that it is possible to mitigate the transmission of gas into the timepiece exterior assembly.

When the inner pressure of the timepiece exterior assembly has become higher than the outside air pressure due to the intrusion of gas, the valve member is moved toward the exterior of the timepiece exterior assembly against the urging member under the atmospheric pressure, and each seal member is arranged at the exhaust position, so that the gas inside the timepiece exterior assembly is discharged to the exterior via the periphery of the valve member. When the valve member is moved by the urging force of the urging member such that the seal members move from the exhaust positions to the sealing positions immediately after the completion of this automatic degassing, even if water outside the timepiece exterior assembly enters the valve member mounting hole, the plurality of seal members serve as banks, and the water having entered the valve member mounting hole can be accumulated in the closed space. The water accumulated in the closed space is pushed out by the flow of the gas from the interior to the exterior of the timepiece exterior assembly at the time of automatic degassing.

A preferred mode of the portable timepiece of the present invention is characterized in that, in a state in which the valve member has been moved toward the exterior of the timepiece exterior assembly by the inner pressure of the timepiece exterior assembly, an axial first separation distance between the seal member on the outer side of the timepiece exterior assembly of the seal members adjacent to each other in the axial direction of the valve member shaft portion and the seal surface where this seal member moves toward and away from, is shorter than an axial second separation distance between the seal member on the inner side of the timepiece exterior assembly of the seal members adjacent to each other and the seal surface where this seal member moves toward and away from.

In this mode of the invention, when automatic degassing is effected, due to the difference between the axial first separation distance and the axial second separation distance, the seal member nearer to the interior of the timepiece exterior assembly first reaches the exhaust position from the sealing position, and then the seal member farther from the interior of the timepiece exterior assembly reaches the exhaust position from the sealing position; from this point in time onward, the gas is discharged to the exterior of the timepiece exterior assembly. Conversely, when the valve member is pushed back by the urging member to be restored to the normal state, the seal member farther from the interior of the timepiece exterior assembly first reaches the sealing position from the exhaust position, and then the seal member nearer to the interior of the timepiece exterior assembly reaches the sealing position from the exhaust position. In this way, a seal is formed by a plurality of seal members with a difference in time. As a result, halfway through the pushing back of the valve member by the same distance as the proper movement stroke by the urging member, it is possible to seal the area around the valve member by the seal member farther from the interior of the timepiece exterior assembly.

A preferred mode of the portable timepiece of the present invention is characterized in that there are provided, as the seal surfaces, a first seal surface, and a second seal surface situated on the outer side of the timepiece exterior assembly with respect to the first seal surface and forming a hole portion of a larger hole diameter than the hole portion formed by the first seal surface, that there are provided, as the escape portions, a first escape portion shared by the first seal surface side portion of the second seal surface, and a second escape portion situated on the outer side of the timepiece exterior assembly with respect to the second seal surface and forming a hole portion of a larger hole diameter than the hole portion formed by the second seal surface, that the valve shaft portion has a first shaft portion opposed to the first seal surface, and a second shaft portion of a larger diameter than the first shaft portion and opposed to the second seal surface, that there are provided, as the seal members, a first seal member, and a second seal member of a larger diameter than the first seal member, and that the first seal member is attached to a peripheral portion of the first shaft portion, with the second seal member being attached to a peripheral portion of the second shaft portion.

In this mode of the invention, there are not provided three or more seal members and a corresponding number of seal surfaces and escape portions, so that, as the axial length of the valve member mounting hole to which the valve member is mounted is minimized, it is possible to achieve the object of the present invention while suppressing an increase in the size of the timepiece exterior assembly.

A preferred mode of the portable timepiece of the present invention is characterized in that the first escape portion has a first tapered surface continuous with the first seal surface, and that the second escape portion has a second tapered surface continuous with the second seal surface.

In this mode of the invention, when machining the first, second seal surfaces and the first, second escape portions on the timepiece exterior assembly, it is possible to sequentially machine them with ease by cutting or the like from the smaller diameter hole portion to the larger diameter portion in accordance with the difference in the diameter of the hole portions corresponding to them, and it is possible to smoothly form the interference of the seal member by a guide action due to a tapered surface.

A preferred mode of the portable timepiece of the present invention is characterized in that an annular groove for the closed space open to the peripheral surface of the valve member shaft portion is formed between the seal members adjacent to each other in the axial direction of the valve member shaft portion.

In this mode of the invention, it is possible to enlarge the volume of the closed space due to the annular groove, so that, even when the amount of water entering from the outside with the completion of degassing is large, it is advantageously possible to accumulate the water in the closed space, making it more difficult for water to enter the interior of the timepiece exterior assembly.

A preferred mode of the portable timepiece of the present invention is characterized in that there is provided, at the second shaft portion side groove end portion of the annular groove, an inclined surface extending between the outer periphery of the second shaft portion and the groove bottom of the annular groove.

In this mode of the invention, it is advantageously possible to smoothly push out the water accumulated in the annular groove to the exterior of the annular groove by the gas discharged at the time of gas exhaust using the inclined surface of this annular groove as a guide.

A preferred mode of the portable timepiece of the present invention is characterized in that the valve member mounting hole is formed by a pipe attached to the timepiece exterior assembly, and that the seal surfaces and the escape portions are provided in the inner periphery of this pipe.

In this mode of the invention, the pipe is singly provided, and it is possible to machine the seal surfaces and the escape portions in the inner periphery thereof, so that it is possible to achieve a superior machinability as compared with the case in which perforation is directly effected on the case band or the like of the timepiece exterior assembly to provide the valve member mounting hole.

A preferred mode of the portable timepiece of the present invention is characterized in that the valve member head portion has a cylindrical peripheral wall, and that a ventilating portion is formed in the cylindrical peripheral wall.

In this mode of the invention, in a degassing state started by moving the valve member toward the exterior of the timepiece exterior assembly by the inner pressure of the timepiece exterior assembly until the cylindrical peripheral wall of the valve member abuts the timepiece exterior assembly, it is possible to establish communication between the inner space of the cylindrical peripheral wall communicating with the valve member mounting hole and the interior of the timepiece exterior assembly via the ventilating portion of the cylindrical peripheral wall. Thus, although the cylindrical peripheral wall abuts the timepiece exterior assembly, there is no break in the degassing route, making it possible to reliably remove the gas inside the timepiece exterior assembly.

According to the present invention, it is possible to provide a portable timepiece which helps to mitigate the transmission of gas into the interior of the timepiece exterior assembly via the periphery of the valve member of the automatic degassing valve, and in which water is not easily allowed to enter the interior of the timepiece exterior assembly from the outside with the completion of the degassing operation.

DETAILED DESCRIPTION OF THE PREFERRED EMBODIMENT

Figure 1:
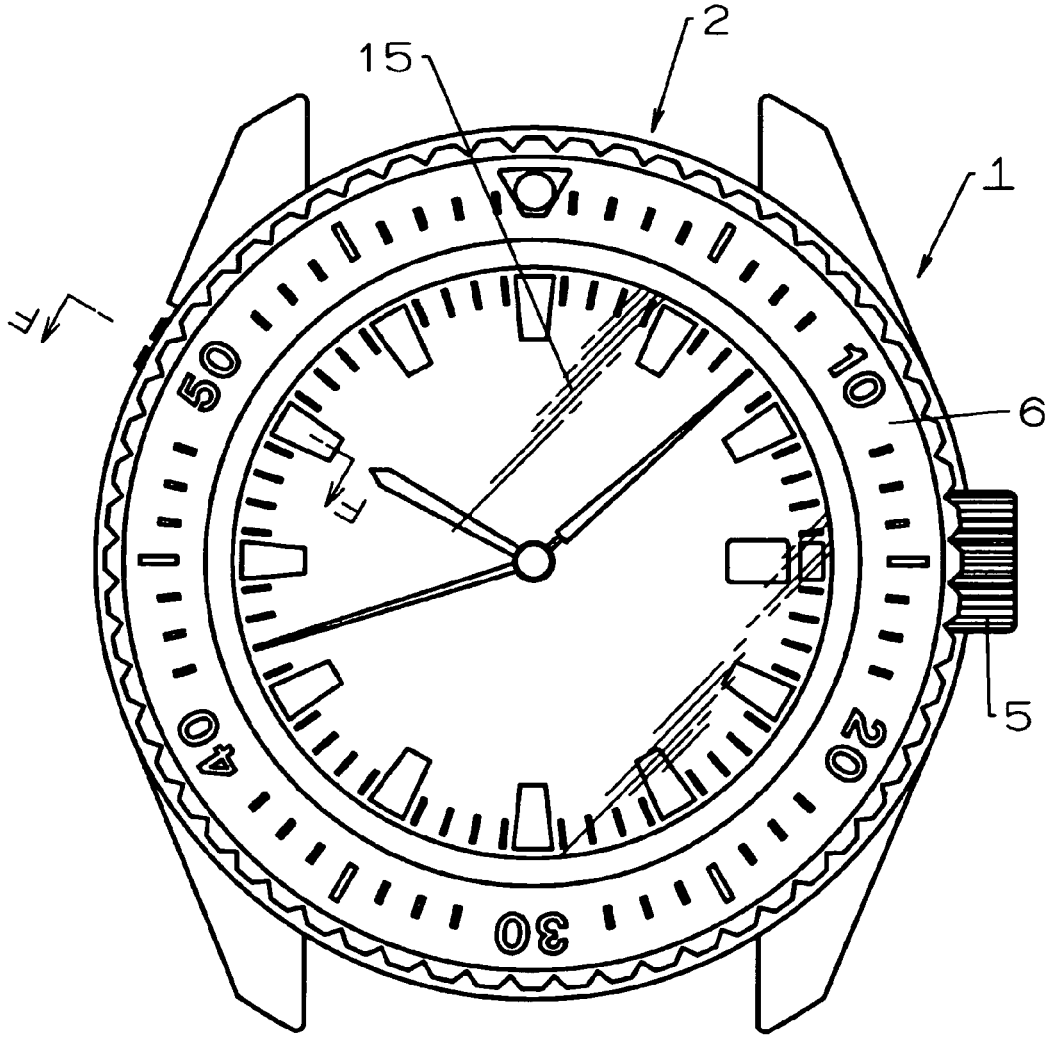
FIG. 1 is a plan view of a wristwatch according to an embodiment of the present invention.

In the following, an embodiment of the present invention will be described in detail with reference to the drawings.

In FIGS. 1 through 4, numeral 1 indicates a portable timepiece, for example, a wristwatch such as a diver's watch also suitable for use in saturation diving. The wristwatch 1 is equipped with a timepiece exterior assembly 2, a valve member 31, a plurality of, e.g., two, seal members 41, 42, and an urging member such as a coil spring 45. A pipe 23 constituting a valve member mounting hole of the timepiece exterior assembly 2 described below, the valve member 31, the seal members 41, 42, and the coil spring 45 constitute an automatic degassing valve 9 for automatically reducing the inner pressure of the timepiece exterior assembly 2.

Figure 2:
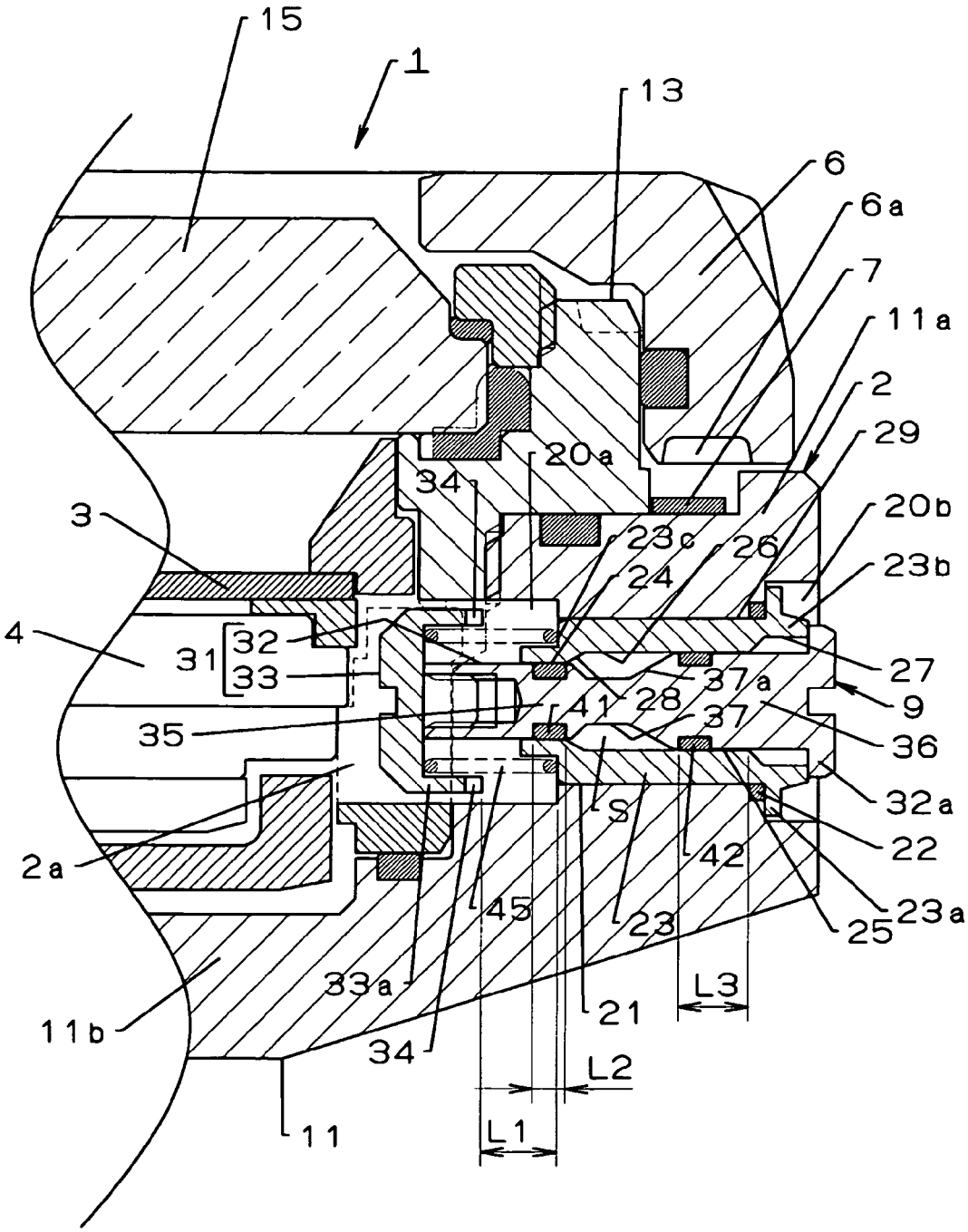
FIG. 2 is a sectional view showing the wristwatch of FIG. 1 taken along the line F-F of FIG. 1 in a state prior to degassing via a degassing valve thereof.
Figure 3:
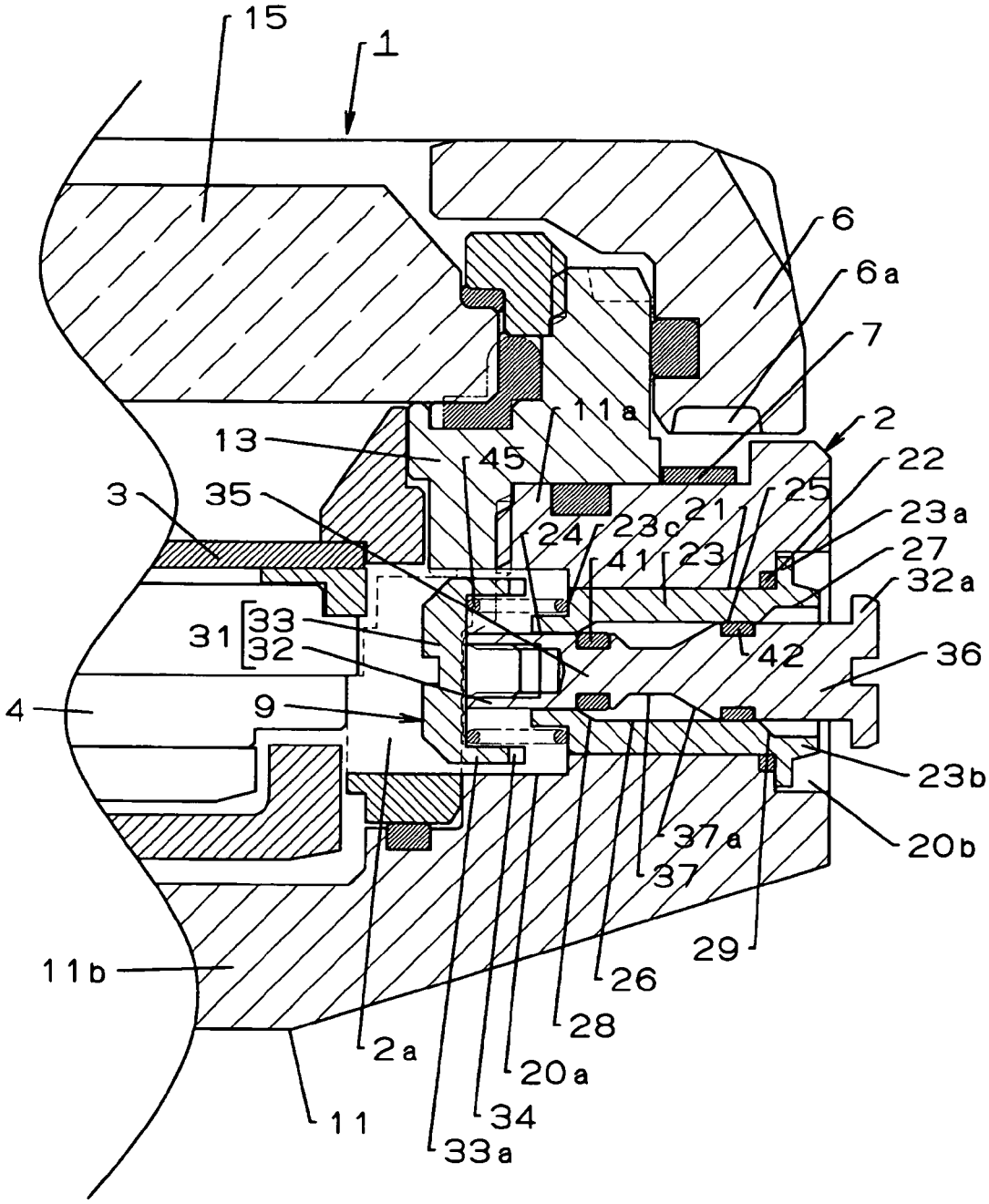
FIG. 3 is a sectional view showing the wristwatch of FIG. 1 taken along the line F-F of FIG. 1 in a state in which the degassing valve thereof is in operation.
Figure 4:
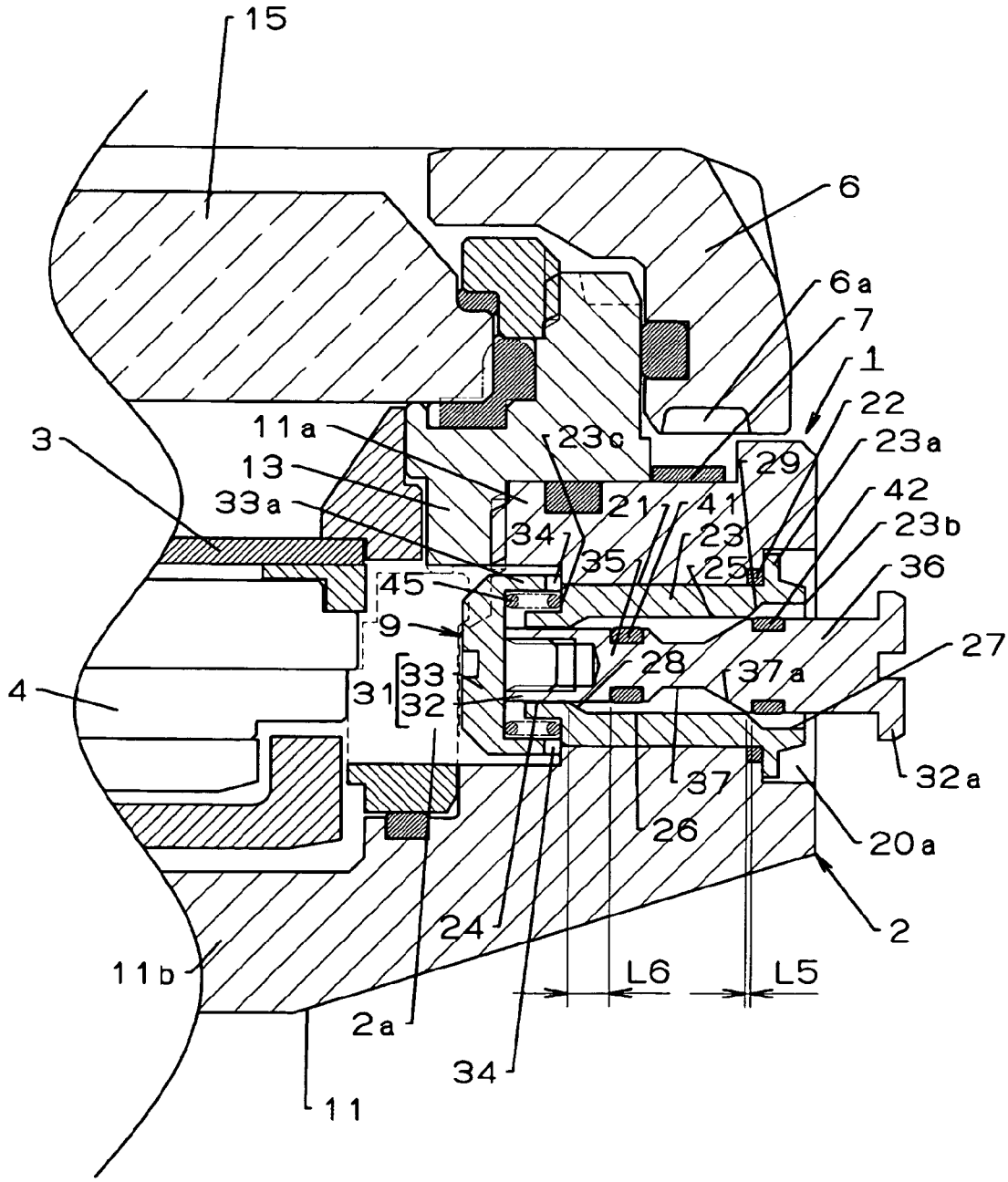
FIG. 4 is a sectional view showing the wristwatch of FIG. 1 taken along the line F-F of FIG. 1 in a state in which degassing has been completed via the degassing valve thereof.

As shown in FIGS. 2 through 4, the timepiece exterior assembly 2 contains a time indication plate 3 and a movement 4, and, as shown in FIG. 1, a crown 5 is mounted to the peripheral portion of the timepiece exterior assembly 2.

The timepiece exterior assembly 2 is equipped with a metal exterior member 11 integrally formed by a case band portion 11*a* and a case back portion 11*b*, a glass support member 13, and a cover glass 15. The glass support member 13 is of a ring-like configuration, and is fixed to the case band portion 11*a* by threaded engagement from the front side thereof. The cover glass 15 is attached to the inner side of the glass support member 13 in a liquid-tight fashion, and the back surface thereof is opposed to the time indication plate 3.

Instead of the exterior member 11, it is also possible to adopt a timepiece exterior assembly 2 in which threadedly engaged with a case band corresponding to the case band portion 11*a* is a case back separate therefrom and corresponding to the case back portion 11*b*. Further, mounted to the timepiece exterior assembly 2 is a ring-shaped rotary bezel 6 capable of rotation along the outer periphery of the glass support member 13. The rotary bezel 6 can be kept at rest at an arbitrary rotating position through engagement of a lock member (not shown) of a lock spring 7 with engagement grooves 6*a* (only one of which is shown) provided on the back surface thereof at fixed intervals in the peripheral direction thereof.

As shown in FIGS. 2 through 4, an inner recess 20*a*, an outer recess 20*b*, and a pipe passing hole 21 continuous therewith are provided, for example, in the case band portion 11*a* of the timepiece exterior assembly 2. The inner recess 20*a* and the outer recess 20*b* are round holes, and the inner recess 20*a* is open to an inner portion 2*a* of the timepiece exterior assembly 2 and the outer recess 20*b* is open to the outer surface of the timepiece exterior assembly 2, e.g., the outer surface of the case band portion 11*a*. The pipe passing hole 21 is a round hole of a smaller diameter than the inner recess 20*a* and the outer recess 20*b*. One end of the pipe passing hole 21 is open to the outer recess 20*b*, and the other end thereof is open to the inner recess 20*a*.

A pipe 23 consisting of a round metal straight pipe is inserted into the pipe passing hole 21, and the pipe 23 is brazed to the case band portion 11*a* by a brazing material 22. A flange portion 23*a* for this brazing protrudes integrally from the outer periphery of one end portion of the pipe 23. One end portion of the pipe 23 provided with the flange portion 23*a* constitutes an edge portion 23*b* of the valve member mounting hole, and is accommodated in the outer recess 20*b*. The other end portion of the pipe 23 situated on the inner portion 2*a* side of the timepiece exterior assembly 2 has a spring receiving step portion 23*c*.

As described above, the pipe 23 is attached to the timepiece exterior assembly 2 to provide the valve member mounting hole, so that it is possible to machine the seal surfaces and the escape portions described below in the inner periphery thereof, with the pipe 23 being singly provided. Thus, it is possible to achieve a superior machinability as compared with the case in which the valve member mounting hole is provided by effecting perforation directly on the case band portion 11*a* or the like of the timepiece exterior assembly 2.

The pipe 23 has in its inner periphery a plurality of seal surfaces and a plurality of escape portions continuous therewith. That is, in this embodiment, a first seal surface 24 and a second seal surface 25 are provided in the inner periphery of the pipe 23 so as to be spaced apart from each other in the axial direction of the pipe 23, and a first escape portion 26 and a second escape portion 27 are provided in the inner periphery of the pipe 23 so as to be spaced apart from each other in the axial direction of the pipe 23.

The first seal surface 24 is formed in the inner periphery of the other end portion of the pipe 23, and the second escape portion 27 is formed in the inner periphery of one end portion of the pipe 23. The second seal surface 25 and the first escape portion 26 are formed by the same component. That is, the first escape portion 26 is formed by the first-seal-surface-24-side portion of the second seal surface 25. Thus, the second seal surface 25 also serving as the first escape portion 26 is situated between the first seal surface 24 and the second escape portion 27 and is formed in the inner periphery of the pipe 23. Thus, the first seal surface 24, the first escape portion 26, the second seal surface 25, and the second escape portion 27 are provided so as to be alternately arranged in that order in the axial direction of the pipe 23.

The hole diameter of the hole portion formed by the second seal surface 25 and the first escape portion 26 is larger than the hole diameter of the hole portion formed by the first seal surface 24. The first escape portion 26 has a first tapered surface 28 continuous with the first seal surface 24. Thus, the hole diameter of the hole portion formed by the first escape portion 26 continuous with the interior 2*a* side of the timepiece exterior assembly 2 with respect to the second seal surface 25 is also larger than the hole diameter of the hole portion formed by the first seal surface 24. The hole portion formed by the second escape portion 27 is open to the exterior of the timepiece exterior assembly 2. The second escape portion 27 has a second tapered surface 29 continuous with the second seal surface 25. Thus, the hole diameter of the hole portion formed by the second escape portion 27 is larger than the hole diameter of the hole portion formed by the second seal surface 25.

As described above, the first escape portion 26 and the first seal surface 24 are continuous with each other via the first tapered surface 28, and the second escape portion 27 and the second seal surface 25 are continuous with each other via the second tapered surface 29, so that the inner diameter of the pipe 23 decreases stepwise from one end on the case band exterior (the exterior of the timepiece exterior assembly 2) side of the pipe 23 toward the case band interior side (the interior 2*a* side).

Due to this difference in hole diameter, when machining the first seal surface 24, the first escape portion 26, the second seal surface 25, and the second escape portion 27 on the pipe 23 of the timepiece exterior assembly 2, it is possible to perform the machining sequentially by cutting or the like in ascending order of hole diameter. Thus, the pipe 23 constituting the valve member mounting hole advantageously exhibits satisfactory machinability.

Further, when a valve member 31 described below is pushed back toward the case band inner side (the interior 2*a* side) by the coil spring 45, the movement is advantageously smooth. That is, as the valve member 31 is pushed back, it is possible to suppress, due to the first tapered surface 28, a first seal member 41 described below from being caught when entering the hole portion formed by the first seal surface 24. At the same time, it is possible to insert the first seal member 41, using the first tapered surface 28 as a guide, into the hole portion formed by the first seal surface 24 while causing it to smoothly undergo elastic deformation so as to exhibit interference. Similarly, as the valve member 31 is pushed back toward the case band inner side (the interior 2*a* side), it is possible to suppress, due to the second tapered surface 29, a second seal member 42 described below from being caught when entering the hole portion formed by the second seal surface 25. At the same time, it is possible to insert the second seal member 42, using the second tapered surface 29 as a guide, into the hole portion formed by the second seal surface 25 while causing it to smoothly undergo elastic deformation so as to exhibit interference.

The valve member 31 is equipped with a valve member shaft portion 32 and a valve member head portion 33 connected thereto.

The outer periphery of the valve member shaft portion 32 is round, and the valve member shaft portion 32 is inserted into the pipe 23 from the exterior of the timepiece exterior assembly 2. The valve member shaft portion 32 is movable in the axial direction of the pipe 23, and has a detachment preventing portion 32*a* at the end portion thereof on the outer side of the timepiece exterior assembly 2. The detachment preventing portion 32*a* protrudes integrally from the outer periphery of the above-mentioned end portion in the form of a round flange. The detachment preventing portion 32*a* has a diameter larger than the hole portion formed by the second escape portion 27 and can move toward and away from the edge portion 23*b*, preventing further movement of the valve member 31 from the pipe 23 toward the interior 2*a* side of the timepiece exterior assembly 2 through contact therewith, that is, getting caught thereby.

The valve member head portion 33 has a cylindrical peripheral wall 33*a* of a size suitable for fit-engagement with the inner recess 20*a*. A screw portion protrudes integrally from the center of the back surface of the valve member head portion 33, and the valve member shaft portion 32 is threadedly engaged with this screw portion, whereby the valve member 31 is assembled. To enable this assembly, there is formed, at each of the end portion of the valve member shaft portion 32 on the side of the exterior of the timepiece exterior assembly 2 and the valve member head portion 33, a groove to be engaged with a tool (not shown) for turning the valve member shaft portion 32 and the valve member head portion 33.

The cylindrical peripheral wall 33*a* has a ventilating portion 34 establishing communication between the interior and the exterior of the cylindrical peripheral wall 33*a*. There are provided a plurality of ventilating portions 34 at peripheral intervals in the cylindrical peripheral wall 33*a*. The ventilating portions 34 are provided, for example, so as to be open in the peripheral end surface of the cylindrical peripheral wall 33*a* directed to the bottom of the inner recess 20*a*. The peripheral end surface of the cylindrical peripheral wall 33*a* can abut the bottom of the inner recess 20*a* through pushing-in of the valve member head portion 33. Through this abutment, the movement stroke of the valve member 31 toward the exterior of the timepiece exterior assembly 2 can be properly determined.

The valve member shaft portion 32 has a first shaft portion 35, a second shaft portion 36, and an annular groove 37. The first shaft portion 35 is formed by the valve member head 33 side shaft portion of the valve member shaft portion 32. The second shaft portion 36 is formed by the detachment preventing portion 32*a* side shaft portion of the valve member shaft portion 32. The annular groove 37 is formed at the shaft portion between the first shaft portion 35 and the second shaft portion 36 so as to be open in the outer periphery thereof.

The annular groove 37 has an inclined surface 37*a* at the second shaft portion 36 side groove end portion. The inclined surface 37*a* is provided over the outer periphery of the second shaft portion 36 continuous with the annular groove 37 from the groove bottom of the annular groove 37. Due to this construction, the annular groove 37 has on the second shaft portion 36 side no end surface perpendicular to the groove bottom of the annular groove 37, so that it is possible to smoothly push the water accumulated in the annular groove 37 out of the annular groove 37 by the gas discharged at the time of automatic degassing described below, using the inclined surface 37*a* as a guide.

The diameter of the first shaft portion 35 is of a size suitable for fit-engagement with the hole portion formed by the first seal surface 24, and is smaller than the hole diameter of the hole portion formed by the second seal surface 25 also serving as the first escape portion 26. The diameter of the second shaft portion 36 is larger than the diameter of the first shaft portion 35. Further, the diameter of the second shaft portion 36 is of a size suitable for fit-engagement with the hole portion formed by the second seal surface 25, and is smaller than the hole diameter of the hole portion formed by the second escape portion 27.

The seal members 41, 42 are formed in a ring-like configuration of an elastic material such as synthetic rubber or elastomer. The first seal member 41, which is one of the seal members 41, 42, is fit-engaged with an annular seal groove formed in the peripheral portion of the first shaft portion 35 and is attached thereto. The outer peripheral diameter of the first seal member 41 in its free state is larger than the hole diameter of the hole portion formed by the first seal surface 24, and is smaller than the hole diameter of the hole portion formed by the second seal surface 25 also serving as the first escape portion 26. The second seal member 42, which is the other of the seal members 41, 42, is fit-engaged with an annular seal groove formed in the peripheral portion of the second shaft portion 36 and is attached thereto. The second seal member 42 is of a larger diameter than the first seal member 41. Further, the outer peripheral diameter of the second seal member 42 in its free state is larger than the hole diameter of the hole portion formed by the second seal surface 25, and smaller than the hole diameter of the hole portion formed by the second escape portion 27.

The coil spring 45 is provided in a compressed state between the valve member head portion 33 and the timepiece exterior assembly 2 (more specifically, a spring receiving step portion 23*c* of the pipe 23). The valve member 31 is urged toward the inner side of the timepiece exterior assembly 2 by the urging force of the coil spring 45. As shown in FIG. 2, due to this urging, the valve member 31 is maintained in the state in which the detachment preventing portion 32*a* thereof is kept caught by the edge portion 23*b* of the pipe 23. The coil spring 45 has a spring force (urging force) corresponding to a pressure somewhat higher than the atmospheric pressure.

In the normal state of the wristwatch 1 shown in FIG. 2, of the seal members 41, 42 adjacent to each other in the axial direction of the valve member 31, the first seal member 41 arranged relatively nearer to the interior of the timepiece exterior assembly 2 is slidably held in intimate contact with the first seal surface 24 while elastically deformed, that is, while exhibiting interference. At the same time, of the seal members 41, 42 adjacent to each other in the axial direction of the valve member 31, the second seal member 42 arranged relatively nearer to the exterior of the timepiece exterior assembly 2 is slidably held in intimate contact with the second seal surface 25 while elastically deformed, that is, while exhibiting interference.

Here, when the first seal member 41 and the second seal member 42 are thus arranged while exhibiting interference, they are regarded as arranged at sealing positions. When they are arranged at the sealing positions, the first seal member 41 and the second seal member 42 define a closed space S together with the outer periphery of the valve member shaft portion 32 between them and the second escape portion 27 opposed to this outer periphery. The annular groove 37 is opposed to the closed space S, whereby there is formed the closed space S inclusive of the annular groove 37.

Further, as shown in FIG. 2, when the proper movement stroke of the valve member 31 at the time of automatic exhaust is L1, the first seal member 41 arranged at the sealing position is situated within a distance L2 less than ½ of the stroke on the valve member head portion 33 side with respect to the first escape portion 26 side end of the first seal surface 24, and is held in intimate contact with the first seal surface 24. Similarly, the second seal member 42 arranged at the sealing position is situated within a distance L3 not less than ½ of the stroke and less than 1 stroke on the valve member head portion 33 side with respect to the second escape portion 27 side end of the second seal surface 25, and is held in intimate contact with the second seal surface 25.

In the state in which the wristwatch 1 is being carried about, the first seal member 41 and the second seal member 42 are arranged, as described above, at the sealing positions while exhibiting interference. Thus, there are formed a plurality of (two) sealing portions by these seal members in the axial direction of the valve member 31, and there is formed the closed space S between the sealing portions adjacent to each other in the axial direction of the valve member 31.

In saturation diving, a seal member penetrating gas such as helium gas used in an under-water residential area is transmitted through the portion of the seal member around the cover glass 15 and the portion of the seal member around the valve member 31, so that the gas pressure within the timepiece exterior assembly 2 is enhanced.

In this case, regarding the areas around the valve member 31, they are respectively sealed by the first seal member 41 and the second seal member 42 provided at an interval in the axial direction of the valve member 31, so that the pressure gradient from the exterior to the interior of the timepiece exterior assembly 2 is reduced stepwise. That is, the gas pressure within the hole portion formed by the second escape portion 27, which is equal to the gas pressure of the under-water residential area, is the highest, and the pressure in the closed space S defined by the first seal member 41 and the second seal member 42 is the second highest, and the pressure within the interior 2*a* of the timepiece exterior assembly 2 is the lowest.

Thus, the difference in gas pressure between the hole portion formed by the second escape portion 27 and the closed space S is small, whereby the transmission of helium gas through the second seal member 42 is mitigated; similarly, the difference in gas pressure between the closed space S and the interior 2*a* of the timepiece exterior assembly 2 is small, whereby the transmission of helium gas through the first seal member 41 is mitigated. In this way, the transmission of gas via the area around the valve member 31 is mitigated, so that it is possible to suppress an increase in the inner pressure of the timepiece exterior assembly 2.

When the user has risen to the surface of the water from the under-water residential area, the inner pressure of the timepiece exterior assembly 2 at that point in time is higher than the pressure outside the timepiece exterior assembly 2 (the atmospheric pressure). Thus, when this inner pressure is larger than the spring force of the coil spring 45, the valve member 31 is moved toward the exterior of the timepiece exterior assembly 2 while further compressing the coil spring 45 due to the inner pressure of the timepiece exterior assembly 2. As a result, the automatic degassing valve 9 is automatically opened, and the high pressure gas in the interior 2*a* of the timepiece exterior assembly 2 is discharged to the exterior of the timepiece exterior assembly 2.

FIG. 3 shows a state in which, in this degassing, the valve member 31 is halfway through its movement, e.g., a state in which the valve member 31 has been pushed in by substantially ½ of the proper movement stroke L1 of the valve member 31 when the valve member 31 is properly moved.

In this state, the second seal member 42 nearer to the exterior of the timepiece exterior assembly 2 is held in intimate contact with the second seal surface 25 still exhibiting interference, whereas the first seal member 41 nearer to the interior 2*a* of the timepiece exterior assembly 2 is detached from the first seal surface 24, and is opposed to the first escape portion 26. Thus, the first seal member 41 has been restored to the free state in which there is no interference, and the closed space S is open to the gap formed between the first seal member 41 and the first escape portion 26. Thus, via this gap, the pressure between the first seal member 41 and the second seal member 42 is made equal to the pressure in the interior 2*a* of the timepiece exterior assembly 2.

FIG. 4 shows a state in which the valve member 31 has been moved by the proper movement stroke L1 and in which the peripheral end surface of the cylindrical peripheral wall 33*a* of the valve member head portion 33 abuts the bottom of the inner recess 20*a*. When the valve member 31 is thus properly moved toward the exterior of the timepiece exterior assembly 2, the second seal member 42 is detached from the second seal surface 25, and is opposed to the second escape portion 27. Also in this state, the first seal member 41 is opposed to the first escape portion 26.

In this state, an axial first separation distance L5 between the second seal member 42 nearer to the exterior of the timepiece exterior assembly 2 and the second seal surface 25 toward and away from which it moves, is shorter than an axial second separation distance L6 between the first seal member 41 nearer to the interior 2*a* of the timepiece exterior assembly 2 and the first seal surface 24 toward and away from which it moves. Here, when both the first seal member 41 and the second seal member 42 are arranged so as to be opposed to the corresponding escape portions, the first seal member 41 and the second seal member 42 are regarded as arranged at the exhaust positions.

Due to this arrangement, the second seal member 42 is restored to the free state in which it exhibits no interference, and the space between the first seal member 41 and the second seal member 42 communicates with the exterior of the timepiece exterior assembly 2 via the gap formed between the second seal member 42 and the second escape portion 27.

As described above, as the valve member 31 is pushed out toward the exterior of the timepiece exterior assembly 2 due to the inner pressure of the timepiece exterior assembly 2, the first seal member 41 nearer to the interior 2*a* of the timepiece exterior assembly 2 first reaches the exhaust position from the sealing position thereof (See the state of FIG. 3). After this, the second seal member 42 farther from the interior 2*a* of the timepiece exterior assembly 2 reaches the exhaust position from the sealing position thereof (See the state of FIG. 4).

Thus, from this point in time onward, the gas within the interior 2*a* of the timepiece exterior assembly 2 flows out into the exterior of the timepiece exterior assembly 2 via the area around the valve member 31. In this case, due to the provision of the ventilating portions 34 of the valve member head portion 33, although the forward end of the cylindrical peripheral wall 33*a* abuts the bottom of the inner recess 20*a* as described above, it is possible to maintain communication between the gap between the valve member shaft portion 32 and the pipe 23 and the interior 2*a* of the timepiece exterior assembly 2. Thus, due to the ventilating portions 34, the degassing route is secured without a break, so that it is possible to reliably remove the gas within the interior 2*a* of the timepiece exterior assembly 2. And, when water is accumulated in the closed space S as described below with this degassing, it is possible to push out the water from the closed space S by the flow of the gas discharged to the exterior from the interior 2*a* of the timepiece exterior assembly 2.

As described above, at the same time that the degassing is completed and the inner pressure of the timepiece exterior assembly 2 becomes equal to the atmospheric pressure, the valve member 31 is pushed back toward the inner side of the timepiece exterior assembly 2 by the spring force of the coil spring 45, so that each of the first seal member 41 and the second seal member 42 is moved from the exhaust position to the sealing position, and the normal state as shown in FIG. 2 is restored.

When the valve member 31 is thus moved by the coil spring 45 such that the first seal member 41 and the second seal member 42 move from the exhaust positions to the sealing positions, it can happen that the water having entered the hole portion formed by the second escape portion 27 of the pipe 23 by that time strives to enter the interior 2*a* of the timepiece exterior assembly 2. In this case, each of the first seal member 41 and the second seal member 42 serves as a bank, so that it is difficult for the water having entered the pipe 23 to reach the interior 2*a* of the timepiece exterior assembly 2.

At this time, it is possible to accumulate the water having gotten over the second seal member 42 in the closed space S being formed. As a result, it is possible to suppress more reliably intrusion of water into the interior 2*a* of the timepiece exterior assembly 2. Further, a large volume is secured for the closed space S due to the annular groove 37 facing the same. Thus, even when the intrusion amount of water at the time of completion of the degassing is large, the water is accumulated in the closed space S, so that it is possible to make it more difficult for the water to get over the first seal member 41 and enter the interior 2*a* of the timepiece exterior assembly 2.

Further, when the valve member 31 is pushed back toward the inner side of the timepiece exterior assembly 2 by the coil spring 45 and the automatic degassing valve 9 is restored to the normal state upon completion of the above degassing, due to the difference between the axial first separation distance L5 and the axial second separation distance L6, the second seal member 42 farther from the interior 2*a* of the timepiece exterior assembly 2 first reaches the sealing position from the exhaust position thereof. After this, the first seal member 41 nearer to the interior 2*a* of the timepiece exterior assembly 2 reaches the sealing position from the exhaust position thereof.

In this way, the seal is formed by a plurality of seal members 41, 42 with a difference in time. As a result, before the valve member 31 is pushed back by the same distance as the proper movement stroke L1, for example, at an early stage as from the start of the movement of the valve member 31 toward the inner side of the timepiece exterior assembly 2, there is attained a state in which the second seal member 42 farther from the interior 2*a* of the timepiece exterior assembly 2 is arranged at the sealing position to exhibit interference. Thus, in this regard, it is possible to make it difficult for the water outside the timepiece exterior assembly 2 to enter the interior 2*a* of the timepiece exterior assembly 2 through the pipe 23 constituting the valve member mounting hole.

In the embodiment described above, there are not provided three or more seal members and a corresponding number of seal surfaces and escape portions, so that, as the axial length of the pipe 23 to which the valve member 31 is mounted is minimized, it is possible to suppress an increase in the size of the timepiece exterior assembly 2.

What is claimed is:

1. A portable timepiece comprising:

a timepiece exterior assembly having a button mounting hole establishing communication between an interior and an exterior of the timepiece exterior assembly, the button mounting hole having a plurality of seal surfaces and a plurality of escape portions;

a valve member having a valve member shaft portion and a valve member head portion, the valve member shaft portion having a detachment preventing portion configured to be caught by an edge portion of the valve member mounting hole from the exterior of the timepiece exterior assembly and being movably inserted into the valve member mounting hole so that the valve member can move toward the exterior of the timepiece exterior assembly by an inner pressure of the timepiece exterior assembly, and the valve member head portion being arranged inside the timepiece exterior assembly while being connected to the valve member shaft portion;

an urging member provided between the valve member head portion and the timepiece exterior assembly for urging the valve member toward the interior of the timepiece exterior assembly; and a plurality of seal members mounted to the valve member shaft portion in correspondence with the plurality of seal surfaces, the plurality of seal members being configured to be moved between a sealing position in which the plurality of seal members are held in contact with the seal surfaces while exhibiting interference and an exhaust position opposed to the escape portions through axial reciprocating movement of the valve member, the plurality of seal members defining in the sealing position thereof a closed space together with an outer periphery of the valve member shaft portion and the escape portions opposed to the outer periphery of the valve member shaft portion.

2. A portable timepiece according to claim 1; wherein the plurality of seal members comprise first and second seal members disposed adjacent to each other in the axial direction of the valve member shaft portion, the first and second seal members being arranged on inner and outer sides, respectively, of the timepiece exterior assembly; and wherein in a state in which the valve member has been moved toward the exterior of the timepiece exterior assembly by the inner pressure of the timepiece exterior assembly, an axial first separation distance between the second seal member and the corresponding seal surface of the second seal member is shorter than an axial second separation distance between the first seal member and the corresponding seal surface of the first seal member.

3. A portable timepiece according to claim 1; wherein the plurality of seal surfaces comprise a first sea surface arranged on an inner side of the timepiece exterior assembly and a second seal surface arranged on an outer side of the timepiece exterior assembly, each of the first and second seal surfaces forming a hole portion with the hole portion formed by the second seal surface having a larger hole diameter than that of the hole portion formed by the first seal surface;

wherein the plurality of escape portions comprise a first escape portion shared by tie a first seal surface side portion of the second seal surface, and a second escape portion arranged on the outer side of the timepiece exterior assembly with respect to the second seal surface and forming a hole portion of a larger hole diameter than the hole portion formed by the second seal surface;

wherein the valve member shaft portion of the valve member has a first shaft portion opposed to the first seal surface and a second shaft portion of a larger diameter than the first shaft portion and opposed to the second seal surface; and wherein the plurality of seal members comprise a first seal member and a second seal member of a larger diameter than the first seal member, the first seal member being attached to a peripheral portion of the first shaft portion and the second seal member being attached to a peripheral portion of the second shaft portion.

4. A portable timepiece according to claim 3; wherein the first escape portion has a first tapered surface continuous with the first seal surface, and the second escape portion has a second tapered surface continuous with the second seal surface.

5. A portable timepiece according to claim 1; further comprising an annular groove formed in the outer periphery of the valve member shaft portion and between the seal members so as to oppose the closed space.

6. A portable timepiece according to claim 5; wherein the valve member shaft portion comprises a first shaft portion and a second shaft portion with the annular groove disposed therebetween; and further comprising an inclined surface extending between an outer periphery of the second shaft portion and a bottom of the annular groove.

7. A portable timepiece according to claim 1; wherein the valve member mounting hole is formed by a pipe attached to the timepiece exterior assembly, the plurality of seal surfaces and the plurality of escape portions being provided in an inner periphery of the pipe.

8. A portable timepiece according to claim 1; wherein the valve member head portion has a cylindrical peripheral wall; and further comprising a ventilating portion formed in the cylindrical peripheral wall of the valve member head portion.

* * * * *